US010327488B2

(12) United States Patent
Chumbler

(10) Patent No.: US 10,327,488 B2
(45) **Date of Patent: *Jun. 25, 2019**

(54) RACE BIB PROTECTIVE POCKET

(71) Applicants: Brian Chumbler, Tucson, AZ (US); Orlando Alva, Tucson, AZ (US)

(72) Inventor: Brian Chumbler, Tucson, AZ (US)

( * ) Notice: Subject to any disclaimer, the term of this patent is extended or adjusted under 35 U.S.C. 154(b) by 105 days.

This patent is subject to a terminal disclaimer.

(21) Appl. No.: 15/424,078

(22) Filed: Feb. 3, 2017

(65) Prior Publication Data

US 2017/0143062 A1 May 25, 2017

Related U.S. Application Data

(63) Continuation-in-part of application No. 14/921,368, filed on Oct. 23, 2015, now abandoned, which is a (Continued)

(51) Int. Cl.
*A45F 5/02* (2006.01)
*A41D 27/20* (2006.01)
(Continued)

(52) U.S. Cl.
CPC ..... *A41D 27/201* (2013.01); *A41D 13/0015* (2013.01); *A41D 27/20* (2013.01);
(Continued)

(58) Field of Classification Search
CPC ..... A41D 27/20; A41D 13/0015; A41D 2600/10; A41D 1/08; A41D 1/002;
(Continued)

(56) References Cited

U.S. PATENT DOCUMENTS 1,060,229 A 4/1913 Casper et al.
1,436,854 A 11/1922 Brady
(Continued)

FOREIGN PATENT DOCUMENTS

EP 0095419 A1 11/1983
GB 2054349 A 2/1981
GB 2089644 A 6/1982

*Primary Examiner* — Robert H Muromoto, Jr.
(74) *Attorney, Agent, or Firm* — Greenberg Traurig, LLP

(57) ABSTRACT

A protective pocket is provided for a substantially two-dimensional object, such as a race bib. The protective pocket includes cooperating first and second lightweight fabrics, and an opening for receiving the object. The first fabric may be an item of a race participant's apparel or a backing that itself is attached to such an apparel item. The second fabric may be a mesh member having spaced apertures through which the object is visible and exposed to elements. The first and second fabrics may be removeably secured to one another. The protective pocket is configured to maintain the object in a substantially vertical planar orientation, and thereby in an "upright" position, such that it that is (a) substantially parallel to the plane defined by the adjacent surface of the race participant's apparel item, and (b) substantially parallel to the plane defined by the adjacent body part of the race participant (e.g., a torso or leg). This positioning also improves the visibility of the indicia printed on the object through the mesh member. Methods of providing a memento from a competitive athletic event using the protective pockets are also disclosed herein.

19 Claims, 5 Drawing Sheets

Related U.S. Application Data continuation of application No. 14/090,794, filed on Nov. 26, 2013, now Pat. No. 9,173,441.

(60) Provisional application No. 61/803,935, filed on Mar. 21, 2013.

(51) Int. Cl.

| | |
|---|---|
| ***A41D 13/00*** | (2006.01) |
| ***G09F 3/20*** | (2006.01) |
| ***G09F 21/02*** | (2006.01) |
| *A45F 5/00* | (2006.01) |

(52) U.S. Cl.

CPC ..... *G09F 3/20* (2013.01); *G09F 21/026* (2013.01); *A41D 2300/32* (2013.01); *A41D 2600/10* (2013.01)

(58) Field of Classification Search

CPC ..... A41D 2600/104; A41D 27/08; A41D 27/205; A41D 11/00; A41D 13/0012; A41D 2300/32; A41D 27/201; A41D 31/00; A41D 1/084; A41D 1/089; G09F 21/026; G09F 3/20; G09F 23/0066; G09F 17/00; G09F 21/02; G09F 23/00; A45F 5/00; A45F 2005/008; A45F 5/02; A45C 13/002; A45C 2011/003; A45C 2013/1015; A45C 11/18; A45C 13/42; A63B 2071/0694; A63B 2209/10

See application file for complete search history.

(56) References Cited

U.S. PATENT DOCUMENTS 2,022,793 A 12/1935 Trickel
2,596,884 A 3/1952 Bailen
2,671,902 A 3/1954 Grue
2,821,035 A 1/1958 Joseph
2,871,485 A 2/1959 Greco
2,986,743 A 6/1961 Eilen
3,051,962 A 9/1962 Lippman
3,370,370 A 2/1968 Lippman
3,371,829 A 3/1968 Phillips
3,582,993 A 6/1971 Keller
3,643,360 A * 2/1972 Vogl ..... B42F 17/00 40/405
3,647,056 A 3/1972 Jacobson et al.
3,744,059 A 7/1973 Hayes
3,797,717 A 3/1974 Collins
4,259,797 A 4/1981 Belser
4,327,447 A * 5/1982 Carnaghi ..... A41D 27/20 2/247
4,386,437 A * 6/1983 Fosher ..... A42B 1/241 2/10
4,389,801 A 6/1983 Sharrock
4,549,916 A 10/1985 Off et al.
4,602,390 A 7/1986 Morera et al.
4,625,337 A 12/1986 Zahn
4,637,151 A * 1/1987 Love ..... G09F 23/0066 40/584
4,650,219 A 3/1987 Sigman
4,698,848 A 10/1987 Buckley
4,710,981 A 12/1987 Sanchez
4,834,688 A 5/1989 Jones
4,871,193 A * 10/1989 Worndli ..... B41L 1/22 283/72
4,875,237 A 10/1989 Cohen
4,899,395 A 2/1990 Spector
4,924,613 A 5/1990 Levin
4,969,214 A 11/1990 Cohen
5,005,219 A 4/1991 Diaz
5,031,763 A 7/1991 Lynam
5,042,091 A 8/1991 Tonkens
5,073,987 A 12/1991 Crosier
5,121,505 A 6/1992 Ludmer et al.
5,173,968 A 12/1992 Fox
5,299,324 A 4/1994 Zinna
5,398,345 A 3/1995 Kenneth et al.
5,465,426 A 11/1995 Beaton
5,468,152 A 11/1995 Lenart
5,517,696 A * 5/1996 Krugler ..... A41D 27/20 2/250
5,561,865 A 10/1996 Fjelstul
5,581,815 A 12/1996 Hans
5,583,489 A 12/1996 Loemker et al.
5,632,044 A 5/1997 Sloot
5,634,579 A * 6/1997 Baclawski ..... A45F 3/04 2/102
5,642,526 A 7/1997 Thompson
5,669,078 A 9/1997 Scremin et al.
5,724,679 A 3/1998 Hans
5,737,775 A 4/1998 Schwartz
5,809,576 A 9/1998 Huston et al.
5,829,657 A * 11/1998 Romer, Jr. ..... A45C 13/42 224/610
5,832,540 A 11/1998 Knight
5,870,777 A 2/1999 Hans
5,881,384 A * 3/1999 Williams ..... A41D 19/01 2/158
5,913,409 A 6/1999 Test
5,933,873 A * 8/1999 Curran ..... A41D 27/20 2/108
5,943,698 A 8/1999 Blanks, I
5,953,757 A * 9/1999 Blanks, I ..... A41D 27/08 2/108
5,961,018 A * 10/1999 Abelbeck ..... B62B 3/146 224/411
6,023,790 A 2/2000 Schwartz
6,119,614 A 9/2000 Kimura
6,131,205 A 10/2000 Arem
6,179,159 B1 1/2001 Gurley
6,487,725 B1 12/2002 Jordan
D479,400 S 9/2003 Clymer
6,679,405 B2 * 1/2004 Zalis-Hecker ..... A45C 1/04 150/107
6,751,805 B1 6/2004 Austion
6,763,632 B1 7/2004 Exby
6,769,139 B1 * 8/2004 Goldkind ..... A41D 11/00 2/227
6,810,529 B1 11/2004 Reilly et al.
6,845,518 B1 1/2005 Boesen
7,003,810 B2 * 2/2006 Goldkind ..... A41D 11/00 2/227
7,146,667 B2 * 12/2006 Elsener ..... B25F 1/04 7/118
7,168,098 B2 1/2007 West
7,254,841 B1 8/2007 Nelson et al.
7,296,303 B1 11/2007 Samet
7,360,334 B2 4/2008 Christiansen
7,392,608 B1 * 7/2008 Jacobs/Ziebell ..... B42D 15/045 229/68.1
7,444,772 B2 11/2008 Harasawa et al.
7,454,856 B2 11/2008 Passman
7,620,998 B2 11/2009 Sandoval
7,992,225 B2 8/2011 Demus
8,032,948 B2 10/2011 Anderson
8,209,772 B2 7/2012 Curry
8,316,469 B2 11/2012 Miller
8,321,964 B2 * 12/2012 Gernes ..... A41B 9/001 2/247
8,453,265 B2 6/2013 Forte et al.
9,173,441 B2 * 11/2015 Chumbler ..... A41D 27/20
9,743,743 B2 * 8/2017 Grote ..... A45F 5/00
2001/0004577 A1 6/2001 Lewis
2002/0041789 A1 * 4/2002 Conklin ..... B42F 13/0006 402/73
2002/0144442 A1 10/2002 Harasawa et al.
2003/0070206 A1 4/2003 Palumbo
2003/0101502 A1 6/2003 Hayes
2004/0058121 A1 * 3/2004 Schriefer ..... A44B 18/0003 428/99

(56) References Cited

U.S. PATENT DOCUMENTS

2005/0000001 A1* 1/2005 Goldkind ..... A41D 11/00 2/227
2005/0114988 A1 6/2005 Dow
2006/0026735 A1 2/2006 Kensic
2006/0080752 A1 4/2006 Darling et al.
2006/0206990 A1 9/2006 Demus
2006/0211937 A1 9/2006 Eldridge
2008/0222780 A1* 9/2008 Johnson ..... A41D 27/205 2/251
2009/0158489 A1 6/2009 White et al.
2009/0158490 A1 6/2009 White et al.
2010/0035027 A1 2/2010 Hill
2010/0095571 A1 4/2010 James
2010/0180361 A1* 7/2010 Marois ..... A41D 27/20 2/252
2010/0306899 A1 12/2010 Kolb
2010/0325769 A1 12/2010 Tseng
2011/0047669 A1 3/2011 Carr
2011/0067169 A1 3/2011 Compton et al.
2011/0185477 A1 8/2011 Olenicoff
2011/0277219 A1 11/2011 Demus
2011/0290683 A1* 12/2011 High ..... A63B 55/57 206/315.7
2012/0030864 A1* 2/2012 Marois ..... A41D 13/0012 2/251
2012/0060261 A1 3/2012 Raviv
2012/0137399 A1 6/2012 Forte et al.
2012/0151655 A1 6/2012 Jarboe
2012/0152990 A1* 6/2012 Kulas ..... A45F 5/00 224/222
2012/0186000 A1 7/2012 Raviv
2012/0216326 A1 8/2012 Van Kuren et al.
2013/0061367 A1 3/2013 Garneau
2014/0082814 A1* 3/2014 Rober ..... A41D 27/205 2/46
2014/0082822 A1* 3/2014 Rober ..... A41D 27/205 2/84
2014/0231277 A1* 8/2014 Ponski ..... A45C 11/00 206/38
2014/0283283 A1* 9/2014 Chumbler ..... A41D 27/20 2/253
2015/0014400 A1* 1/2015 Schneider ..... B42F 7/065 229/67.1
2015/0371565 A1 12/2015 Urbano
2016/0037842 A1* 2/2016 Chumbler ..... A41D 27/20 2/253
2016/0219947 A1* 8/2016 Nhim ..... A41D 13/0017
2016/0295933 A1* 10/2016 Herbener ..... A41D 27/20
2016/0366954 A1* 12/2016 Barkshire ..... A41D 13/01
2017/0086569 A1* 3/2017 Grote ..... A45F 5/00
2017/0143062 A1* 5/2017 Chumbler ..... A41D 27/20
2017/0313238 A1* 11/2017 Ytterborn ..... B60Q 1/2673

* cited by examiner

RACE BIB PROTECTIVE POCKET

CROSS-REFERENCE TO RELATED APPLICATIONS

The present application is a continuation-in-part of U.S. patent application Ser. No. 14/921,368 (now abandoned), entitled "RACE BIB PROTECTIVE POCKET," filed Oct. 23, 2015 as a continuation of U.S. patent application Ser. No. 14/090,794, entitled "RACE BIB PROTECTIVE POCKET," filed Nov. 26, 2013, now U.S. Pat. No. 9,173,441, which claims priority to U.S. Provisional Patent Application Ser. No. 61/803,935, entitled "IMPROVED POCKET TO PROTECT AND VIEW A RACE NUMBER DURING ADVENTURE RACES," filed Mar. 21, 2013, the disclosures of which are all incorporated by reference herein in their entirety.

FIELD OF THE INVENTION

The present invention relates to semi-translucent protective pockets for use with apparel, and, more particularly, to lightweight, semi-translucent protective pockets for use with athletic apparel to hold substantially two-dimensional objects such as race bibs, race numbers or other athlete-identifying numbers or indicia. The present invention also relates to methods for providing a memento from a competitive athletic event (e.g., a race) using the protective pockets disclosed herein.

BACKGROUND OF THE INVENTION

Participants in competitive athletic events such as marathons and various adventure and endurance obstacle course races, such as Tough Mudder®, are assigned individual numbers or other alpha-numeric identifiers that are printed on substantially two-dimensional rectangular pieces of material (e.g., paper, Tyvek, etc.). These objects are known as race bibs and have a minimal thickness (e.g., see race bib 30 in FIG. 5), so they are being described herein as "substantially two-dimensional" to denote same.

Race bibs are typically secured to race participants' apparel with one or more ordinary safety pins, which can inadvertently become opened during the race, resulting in the loss of the race bib (e.g., it is torn off) and/or the participant being stuck with the sharp point of the pin. The use of safety pins can also damage or ruin the sports apparel.

SUMMARY OF THE INVENTION

In one embodiment, the present invention provides a lightweight, semi-translucent protective pocket comprising a first fabric having a first surface and a second surface opposite the first surface; a second fabric having a perimeter including first, second, third and fourth sides, and having a plurality of spaced apertures; and a border member extending along the first, second and third sides of the perimeter. The border member is secured to one of the surfaces of the first fabric. The first and second fabrics cooperate to form the protective pocket therebetween. The protective pocket has an opening adjacent the fourth side of the perimeter.

The protective pocket is configured to removeably receive a substantially two-dimensional object and maintain the substantially two-dimensional object in a substantially vertical planar orientation, so that it is substantially parallel to the first and second surfaces of said first fabric. In one specific example, the substantially two-dimensional object is a race bib.

The plurality of spaced apertures allows the exposure of the substantially two-dimensional object to elements encountered during a race. The plurality of spaced apertures also facilitates visibility of the substantially two-dimensional object therethrough.

In one embodiment, the first fabric is an item of apparel, or a portion of such an item, and the second fabric is a mesh member. In another embodiment, the first fabric is a backing that is preferably made of a solid sheet of non-mesh material, and the second fabric is a mesh member, wherein the backing is attached to an item of apparel.

In one embodiment, the protective pocket includes a mesh member that is removeably secured to an item of apparel. This embodiment of the protective pocket has a border member including a first border member portion secured to an outer surface of the apparel item and having first closure means, and a second border member portion secured to a perimeter of the mesh member and having second closure means. The second closure means is engageable with the first closure means to removeably secure the mesh member to the apparel item, and form the protective pocket therebetween.

The present invention also relates to methods for providing a memento from a competitive athletic event (e.g., a race) using protective pockets disclosed herein. The method includes at least the steps of providing a race bib having athlete-identifying numbers or indicia thereon; placing the race bib in a protective pocket before the competitive athletic event (the protective pocket including a mesh member), such that the athlete-identifying numbers or indicia of the race bib face outwardly so as to be visible through the mesh member; exposing at least a portion of the race bib to elements encountered during the competitive athletic event (e.g., mud), wherein the memento is formed by the deposition of the elements on the race bib; and removing the memento from the protective pocket after the competitive athletic event.

BRIEF DESCRIPTION OF THE DRAWINGS

For a more complete understanding of the present invention, reference is made to the following detailed description of exemplary embodiments considered in conjunction with the accompanying drawings, in which.

While the above-identified drawings set forth presently disclosed embodiments, other embodiments are also contemplated, as noted in the detailed description. This disclosure presents illustrative embodiments by way of representation and not limitation. Numerous other modifications and embodiments can be devised by those skilled in the art which fall within the scope and spirit of the principles of the presently disclosed invention.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention is intended to be illustrative, and not restrictive. Further, the figures are not necessarily to scale, some features may be exaggerated to show details of particular components. In addition, any measurements, specifications and the like shown in the figures are intended to be illustrative, and not restrictive. Therefore, specific structural and functional details disclosed herein are not to be interpreted as limiting, but merely as a representative basis for teaching one skilled in the art to variously employ the present invention.

Figure 1:
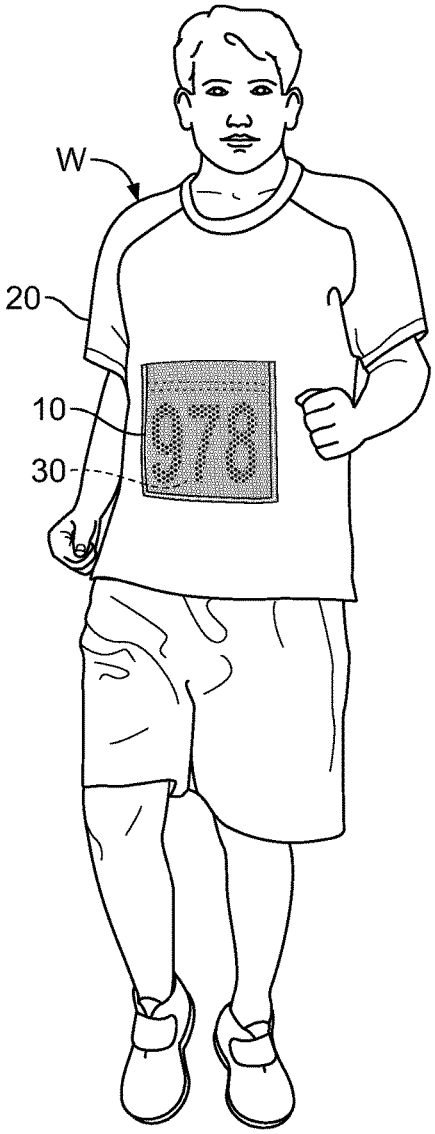
FIG. 1 is an environmental view of a protective pocket according to a first embodiment of the present invention, as used with a shirt by a race participant.
Figure 2:
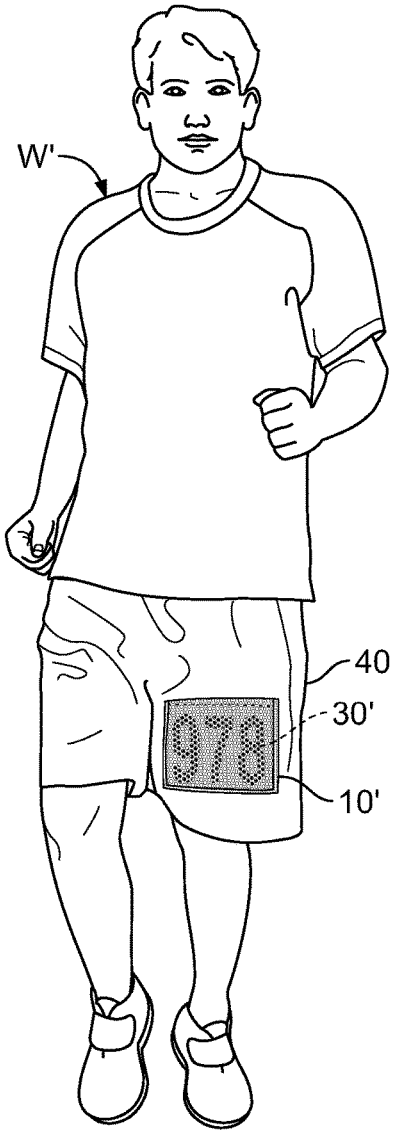
FIG. 2 is an environmental view of a protective pocket according to a second embodiment of the present invention, as used with shorts by a race participant.

FIG. 1 illustrates a first race participant W with a protective pocket 10 constructed in accordance with an embodiment of the present invention. The protective pocket 10 is attached to a shirt 20, which has opposed first (i.e., outer) and second (i.e., inner) surfaces, and contains a race bib 30. FIG. 2 illustrates a second race participant W with a protective pocket 10' attached to a pair of shorts 40, and containing a race bib 30'. The protective pockets 10 and 10' illustrated in FIGS. 1 and 2 are made of one or more lightweight materials. The protective pockets 10 and 10' are each configured to removeably receive a substantially two-dimensional object therein, such as the race bib 30, and secure the substantially two-dimensional object in place on the bodies of participants W and W. The protective pockets 10 and 10' are each further configured to maintain the substantially two-dimensional object in a substantially vertical planar orientation, in which the substantially two-dimensional object is (a) substantially parallel to the plane defined by the adjacent surface of the shirt 20, shorts 40, or other apparel item, and (b) substantially parallel to the plane defined by the adjacent body part of the race participant W or W' (e.g., a torso or leg), as further explained below. It is understood that all of the structural and functional features described below in connection with the protective pocket 10 are also descriptive of the protective pocket 10', unless indicated otherwise.

Figure 3:
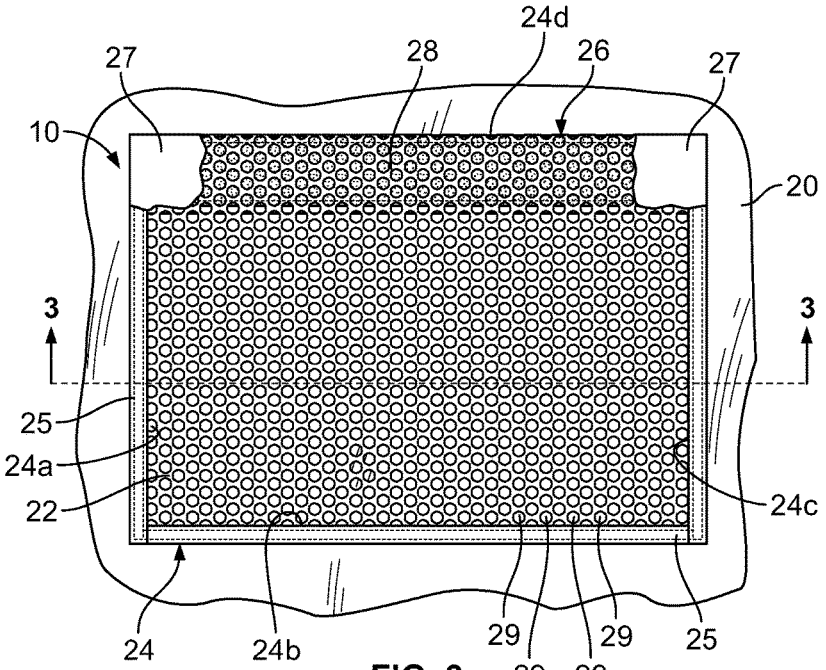
FIG. 3 is a front elevational view of one of the protective pockets of FIGS. 1 and 2, and includes partial cutaways showing the protective flap thereof.
Figure 4:
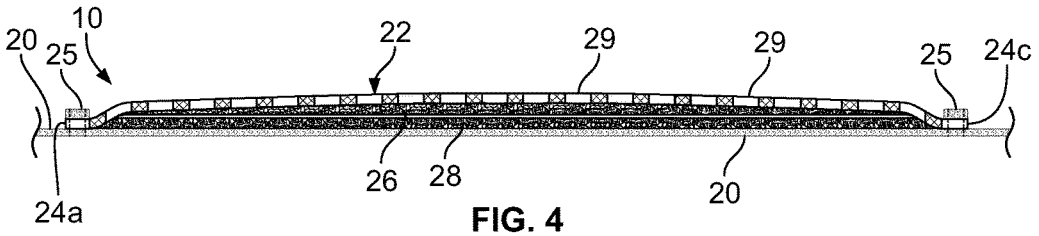
FIG. 4 is a cross-sectional view of the protective pocket of FIG. 3, as taken along lines 3-3.

With reference now to FIGS. 1, 3 and 4, the protective pocket 10 includes a substantially rectangular mesh member 22, through which the race number or other alpha-numeric identifier printed on the race bib 30 is visible (see FIG. 1). The mesh member 22 has a perimeter 24 including first, second, third and fourth sides 24*a*, 24*b*, 24*c* and 24*d*, respectively. The protective pocket 10 further includes a border member 25 that extends along the first, second and third sides 24*a*, 24*b* and 24*c* of the perimeter 24. The border member 25 is attached (e.g., using stitches, adhesive, or other known attachment means) to the shirt 20 (or another apparel item, such as shorts (see FIG. 2), a tank top, pants, a jacket, a sports bra, yoga pants, yoga shorts, boy shorts, a track and field jersey, a triathlon jersey and a cycling jersey), in order to secure the mesh member 22 thereto. The shirt 20 constitutes a first fabric, and the mesh member 22 constitutes a second fabric. Once secured to the shirt 20 via the border member 25, the mesh member 22 cooperates with the shirt to form the protective pocket 10 therebetween.

Figure 5:
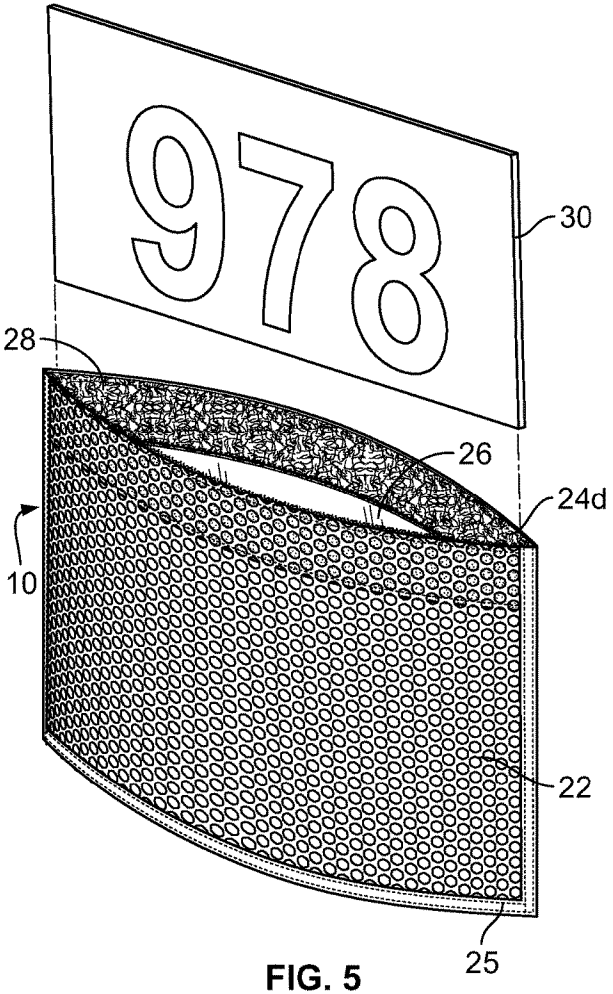
FIG. 5 is a top perspective view of the protective pocket of FIGS. 3 and 4, as being used with a race bib in accordance with an embodiment of the present invention.

As further illustrated in FIGS. 3, 4 and 5, the protective pocket 10 includes an opening 26 along the "top" of the mesh member 22, adjacent to and defined on one side by the fourth side 24*d* of the perimeter 24, and adjacent to and defined on the opposite side by the shirt 20. The opening 26 of the protective pocket is dimensioned so as to receive the race bib 30 therethrough (see FIG. 5), as further discussed below. Once a participant in a competitive athletic event has received his or her race bib (i.e., prior to or at the event), he or she pulls the fourth side 24*d* of the perimeter 24 away from the shirt 20, so as to access the opening 26 of the protective pocket 10. The participant then inserts the race bib 30 through the opening 26, and moves the fourth side 24*d* of the perimeter 24 towards the shirt 20 until touching same in order to close the opening 26, whereupon the race bib 30 is secured within the protective pocket 10.

With continuing reference to FIG. 5, the protective pocket 10 and its opening 26 may be formed with dimensions that are slightly larger than a standard size race bib 30, so as to easily receive the race bib 30 therein. A standard size race bib may be, for example, 8" by 6" or a similar size. Protective pockets 10 may be made for different sizes of race bibs. In an alternate embodiment, the protective pocket 10 and its opening 26 are formed with dimensions that are large enough to receive any utilized size of race bib (or other substantially two-dimensional object) therein.

As indicated above, the protective pocket 10 is configured to maintain the race bib 30 (or other substantially two-dimensional object) in a substantially vertical planar orientation while it is contained in the protective pocket 10. The race bib 30 is thereby maintained in an "upright" position such that it is (a) substantially parallel to the plane defined by the adjacent surface of the shirt 20, or other apparel item, and (b) substantially parallel to the plane defined by the adjacent body part of the race participant W (e.g., a torso, as illustrated in FIG. 1). This positioning also improves the visibility of the race number or other alpha-numeric identifier printed on the race bib 30 through the mesh member 22. In order to facilitate this positioning of the race bib 30 within the protective pocket 10, the mesh member 22 is tightly secured to the shirt 20 (i.e., via the border member 26 along the first, second and third sides 24*a*, 24*b* and 24*c* of the perimeter 24) so as to allow limited movement between open and closed positions. In other words, the protective pocket 10 can only be opened wide enough to receive a substantially two-dimensional object, e.g., the race bib 30, as illustrated in FIG. 5.

In an embodiment, the protective pocket 10 includes closure means by which to maintain opening 26 in a closed position, in order to better secure the race bib 30 in the protective pocket 10. Such closure means may be hook and loop fasteners 28, as illustrated in FIGS. 3-5. Alternative closure means known in the art may also be used, including, but not limited to, a zipper, buttons and snaps. A separate piece of fabric may be provided as a covering (not shown) to protect the closure means. For example, a protective flap 27 may be secured to the protective pocket 10 over the closure means (see FIG. 3). If the protective flap 27 has a double panel construction with open ends, it may also function as an auxiliary compartment for receiving small objects (e.g., pens, lip balm, etc.).

Referring again to FIG. 1, the mesh member 22 is partially opaque, but includes a plurality of spaced apertures 29 through which the number (or other identifying indicia) on the race bib 30 is visible. The apertures 29 in the mesh member 22 facilitate the partial exposure of the race bib 30 such that it can be stained by elements encountered during the race, such as mud. The race participant may thereby keep the stained race bib 30 as a memento of the race.

The mesh member 22 may be made of different types of mesh material, so long as the mesh material is (a) flexible and elastic enough to expand when the protective pocket 10 is opened to insert the race bib 30 through the opening 26, and then return to its unexpanded state, but also (b) rigid enough to maintain the race bib in the upright position, as discussed above. Such materials include polyester and nylon. The mesh member 22 may also have any one of several different mesh styles, aperture patterns, and/or aperture sizes of the suitable mesh materials known in the art. The mesh used in making the mesh member 22 is also lightweight.

Figure 6:
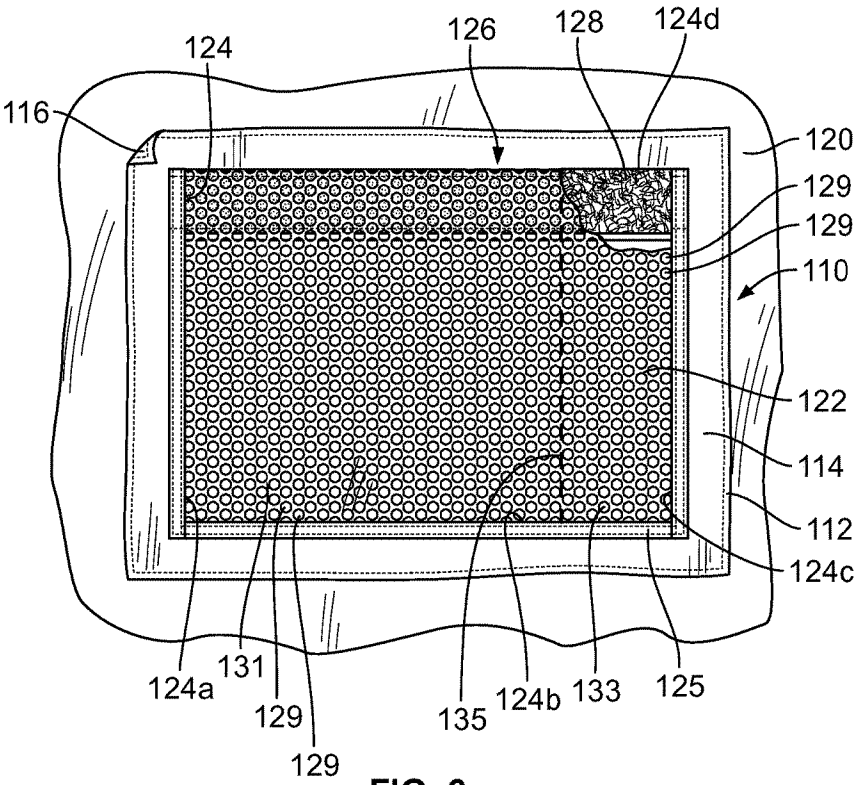
FIG. 6 is a front elevational view of the protective pocket according to a third embodiment of the present invention, and includes a partial cutaway showing the hook and loop fasteners thereof.

Another embodiment of the protective pocket 110 is illustrated with an apparel item 120 (e.g., a shirt, shorts, etc.) in FIG. 6. The elements illustrated in FIG. 6, which correspond to the elements described above with reference to FIGS. 1-5, have been designated by corresponding reference numerals increased by one hundred, while new elements are designated by non-corresponding reference numerals.

With continuing reference to FIG. 6, the first fabric of the protective pocket 110 is a substantially rectangular backing 112 having opposed first (i.e., front) and second (i.e., rear) surfaces 114 and 116, respectively. The backing 112 is preferably made of a solid sheet of non-mesh material (e.g., cotton, polyester, rayon, etc.) The second fabric of the protective pocket is a substantially rectangular mesh member 122, which is similar to the mesh member 22 of the embodiment described above, and may have a smaller surface area than the rectangular backing 112. The mesh member 122 has a perimeter 124 including first, second, third and fourth sides 124*a*, 124*b*, 124*c* and 124*d*, respectively. The protective pocket 110 further includes a border member 125 that extends along the first, second and third sides 124*a*, 124*b* and 124*c* of the perimeter 124. The border member 125 is attached (e.g., using stitches, adhesive, or other known attachment means) to the front surface 114 of the rectangular backing 112, whereby the mesh member 122 cooperates with the front surface 114 to form the protective pocket 110 therebetween. The rear surface 116 of the rectangular backing 112 is attached (e.g., using stitches, adhesive, or other known attachment means) to the item of apparel 120 in order to ultimately secure the mesh member 122 thereto.

As further illustrated in FIG. 6, the protective pocket 110 includes an opening 126 along the "top" of the mesh member 122, adjacent to and defined on one side by the fourth side 124*d* of the perimeter 124, and adjacent to and defined on the opposite side by the front surface 114 of the rectangular backing 112. The opening 126 is dimensioned so as to receive a race bib (not shown) therethrough, similar to the opening 26 of the protective pocket 10 illustrated in FIG. 5 and discussed above. Once a participant in a competitive athletic event has received his or her race bib (i.e., prior to or at the event), he or she pulls the fourth side 124*d* of the perimeter 124 away from the item of apparel 20, so as to access the opening 126 of the protective pocket 110. The participant then inserts the race bib (not shown) through the opening 126, and moves the fourth side 124*d* of the perimeter 124 towards the apparel item 120 until touching same to close the opening 126, whereupon the race bib is secured within the protective pocket 110.

The protective pocket 110 is configured to maintain the race bib (or other substantially two-dimensional object) in a substantially vertical planar orientation while it is contained in the protective pocket 110. The race bib is thereby maintained in an "upright" position such that it is (a) substantially parallel to the plane defined by the adjacent surface of the apparel item 120, and (b) substantially parallel to the plane defined by the adjacent body part of the race participant (e.g., a torso or leg). This positioning also improves the visibility of the race number or other alpha-numeric identifier printed on the race bib through the mesh member 122. In order to facilitate this positioning of the race bib within the protective pocket 110, the mesh member 122 is tightly secured to front surface 114 of the rectangular backing 112 (i.e., via the border member 126 along the first, second and third sides 124*a*, 124*b* and 124*c* of the perimeter 124) so as to allow limited movement between open and closed positions. In other words, the protective pocket 110 can only be opened wide enough to receive a substantially two-dimensional object, e.g., the race bib.

In an embodiment, the protective pocket 110 includes closure means by which to maintain opening 126 in a closed position, in order to better secure the race bib in the protective pocket 110. Such closure means may be hook and loop fasteners 128, as illustrated in FIG. 5. Alternative closure means known in the art may also be used, including, but not limited to, a zipper, buttons and snaps. A separate fabric covering may be provided to protect the closure means, such as the protective flap 27 described above in connection with the protective pocket 10.

Like the mesh member 22 described above, the mesh member 122 is partially opaque, but includes a plurality of spaced apertures 129 through which the number (or other identifying indicia) on the race bib is visible. The apertures 129 in the mesh member 122 facilitate the partial exposure of the race bib such that it can be stained by elements encountered during the race, such as mud. The race participant may thereby keep the stained race bib as a memento of the race. The mesh member 122 may be made of any of the same mesh materials described above in connection with the mesh member 22.

Referring again to FIG. 6, the illustrated embodiment of protective pocket 110 includes first and second compartments 131 and 133, respectively, which are separated by stitching 135. The first compartment 131 is dimensioned to contain a race bib, as described above, while the second compartment 133 is configured to contain another object, such an illuminated glow stick (not shown). Both of the disclosed embodiments of the protective pocket 10 and 110 may have one or more compartments.

In another embodiment, the protective pocket 110 is secured to the apparel item 120 from the inside thereof. A substantially rectangular cut-out having a surface area equal to or approximately equal to that of the mesh member 122 is formed in the apparel item 120. The protective pocket 110 is then positioned against an inside surface of the apparel item 120 such that the mesh member 122 protrudes through the cut-out, but the entire rectangular backing 112 remains inside the apparel item 120. The rectangular backing 112 is then secured to the apparel item 120 such that only the mesh member 122 is visible from the outside of the apparel item 120.

Figure 7:
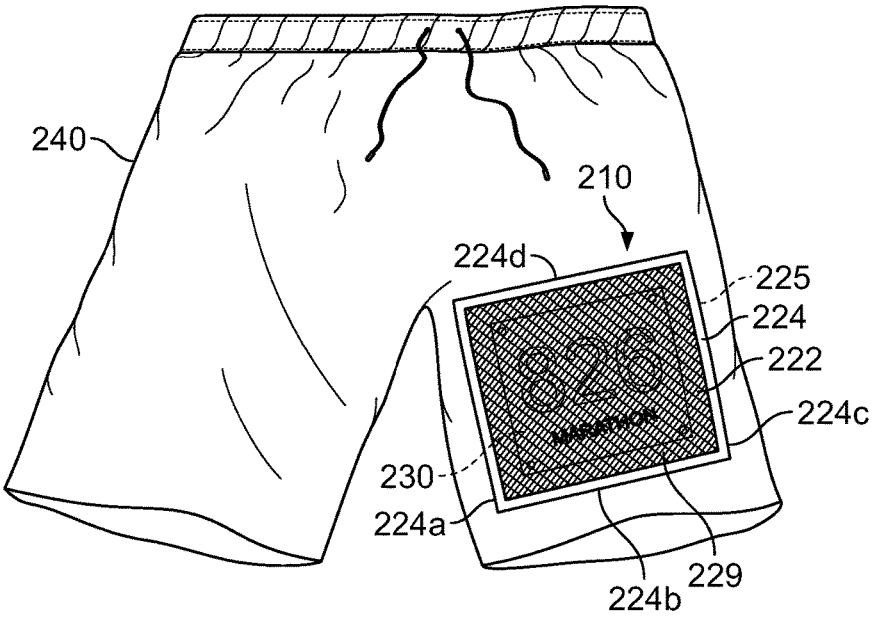
FIG. 7 is an environmental view of a protective pocket according to a fourth embodiment of the present invention, as used with shorts.
Figure 8:
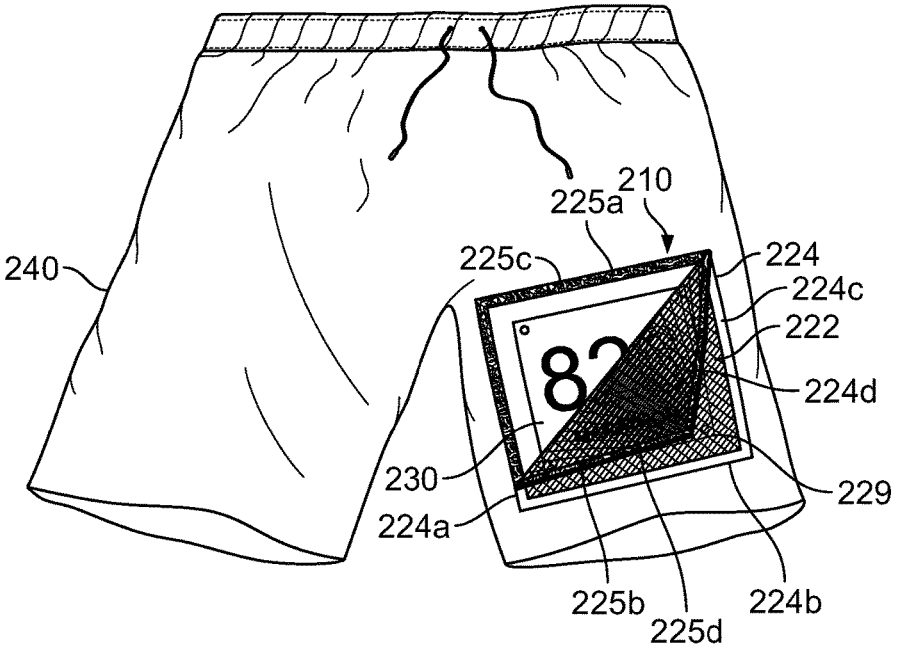
FIG. 8 is an environmental view of the protective pocket of FIG. 7, with the mesh member partially removed from the border member on the shorts.
Figure 9:
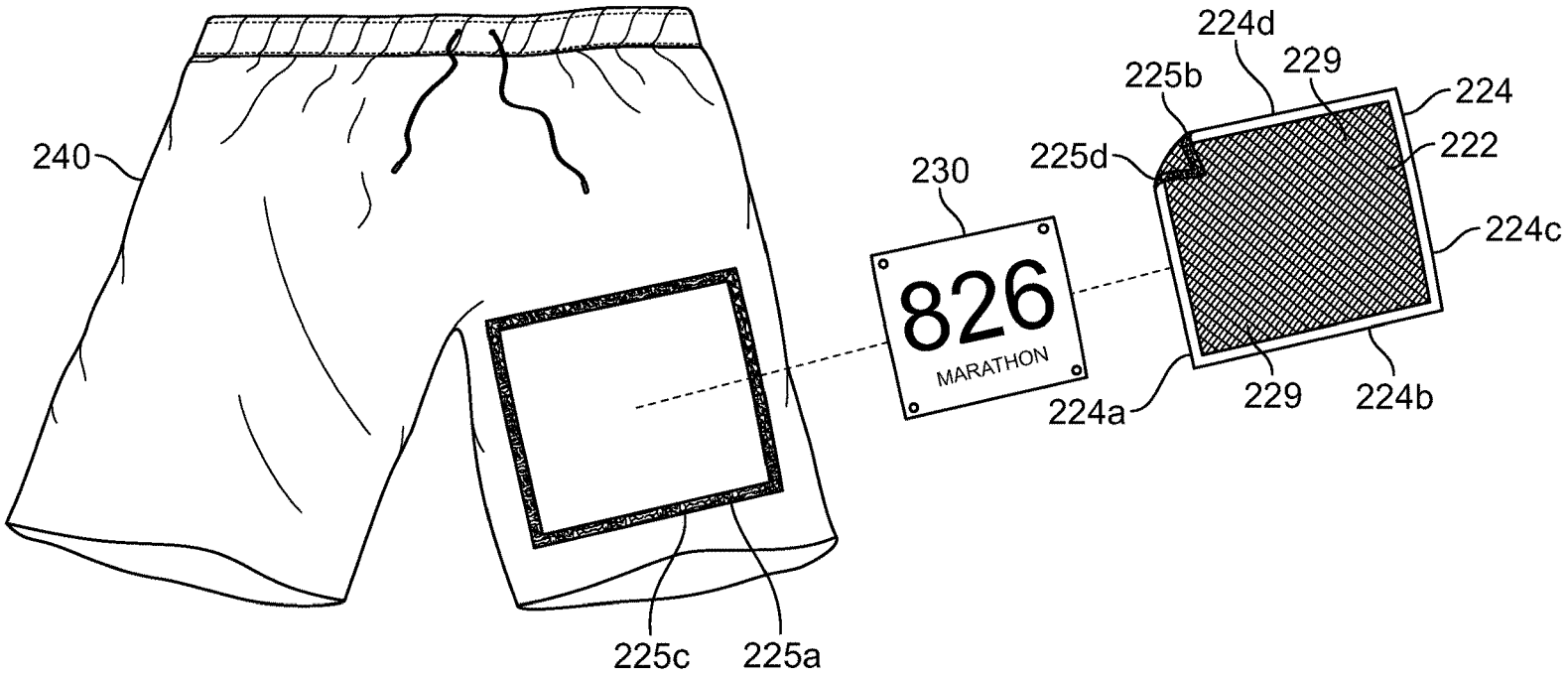
FIG. 9 is an exploded view of the protective pocket of FIGS. 7 and 8.

In another embodiment, the protective pocket is configured to be removeably or permanently secured to an apparel item, or a racing belt. The protective pocket may be secured via hook and loop fasteners, a zipper, buttons, snaps, or any alternative closure means known in the art. Such an embodiment of a protective pocket 210 is illustrated in FIGS. 7-9 with an apparel item 240 (e.g., shorts as shown in FIGS. 7-9, a tank top, pants, a jacket, a shirt, a sports bra, yoga pants, yoga shorts, boy shorts, a track and field jersey, a triathlon jersey and a cycling jersey etc.). The elements illustrated in FIGS. 7-9, which correspond to the elements described above with reference to FIGS. 1-5, have been designated by corresponding reference numerals increased by two hundred, while new elements are designated by non-corresponding reference numerals.

With continuing reference to FIGS. 7-9, the protective pocket 210 includes a substantially rectangular mesh member 222, through which the race number or other alpha-numeric identifier printed on a race bib 230 is visible (see FIG. 7). The mesh member 222 is similar to the mesh member 22 of the embodiment described above. The mesh member 222 has a perimeter 224 including first, second, third and fourth sides 224*a*, 224*b*, 224*c* and 224*d*, respectively.

The protective pocket 210 further includes a two-part border member 225 that includes a first border member portion 225*a* that is secured to (e.g., using stitches, adhesive, or other known attachment means) an outer surface of the apparel item 240, and a second border member portion 225*b* that is secured to (e.g., using stitches, adhesive, or other known attachment means) the perimeter 224 of the mesh member 222. The first and second border member portions 225*a*, 225*b* include complimentary first and second closure means 225*c*, 225*d*, respectively, by which a user (e.g., a participant in a competitive athletic event) removeably secures the race bib 230 in the protective pocket 210, between the mesh member 222 and the apparel item 240. The complimentary closure means 225*c*, 225*d* may be hook and loop fasteners, as illustrated in FIGS. 8 and 9. Alternative closure means known in the art may also be used, including, but not limited to, a zipper, buttons, snaps, or any alternative closure means known in the art.

The apparel item 240 constitutes a first fabric, and the mesh member 222 constitutes a second fabric. In an alternative embodiment, the first fabric is a backing (not shown) that is attached to the apparel item 240. The backing may be similar to the backing 112 of the embodiment described above.

Once secured to the apparel item 240 via the closure means 225*c*, 225*d* of the first and second border member portions 225*a*, 225*b*, the mesh member 222 cooperates with the apparel item 240 to form the protective pocket 210 therebetween to contain the race bib 230 therein, as further disclosed below in connection with FIGS. 7-9.

After a participant in a competitive athletic event has received his or her race bib 230, he or she moves one or more of the first, second, third and/or fourth sides 224*a*, 224*b*, 224*c*, 224*d* of the perimeter 224 of the mesh member 222 away from the apparel item 240, so as to at least partially separate the mesh member 222 from the apparel item 240 (see FIG. 8). In doing so, the participant separates the first and second border member portions 225*a*, 225*b* from one another, at least partially, by disengaging the first and second closure means 225*c*, 225*d*.

The participant then positions the race bib 230 adjacent the apparel item 240 240 (e.g., on the outer surface thereof), so as to be surrounded by (i.e., within) the first border member portion 225*a*. Next, the participant moves the displaced one or more of the first, second, third and fourth sides 224*a*, 224*b*, 224*c* and 224*d* of the perimeter 224 towards the apparel item 240 until the second border member portion 225*b* fully engages and is secured to the first border member portion 225*a* via complimentary closure means 225*c*, 225*d*, whereupon the race bib 230 is secured within the protective pocket 210.

The protective pocket 210 is configured to maintain the race bib 230 (or other substantially two-dimensional object) in a substantially vertical planar orientation while it is contained in the protective pocket 210. The race bib 230 is thereby maintained in an "upright" position such that it is (a) substantially parallel to the plane defined by the adjacent (e.g., outer) surface of the apparel item 240, and (b) substantially parallel to the plane defined by the adjacent body part of the race participant (e.g., a torso or leg). This positioning also improves the visibility of the race number or other alpha-numeric identifier printed on the race bib 230 through the mesh member 222.

Like the mesh member 22 described above, the mesh member 222 is partially opaque, but includes a plurality of spaced apertures 229 through which the number (or other identifying indicia) on the race bib 230 is visible. The apertures 229 in the mesh member 222 facilitate the partial exposure of the race bib 230 such that it can be stained by elements encountered during the race, such as mud. The race participant may thereby keep the stained race bib 230 as a memento of the race. The mesh member 222 may be made of any of the same mesh materials described above in connection with the mesh member 22.

In another embodiment, the protective pocket includes two cords secured at opposite sides thereof (e.g., one cord at each of two opposed corners) and in between the first and second fabrics. The ends of the cords opposite those secured to the protective pocket include closure means, such as toggles or rope locks. The cords are inserted through the race bib and thereby used to secure the race bib in place (e.g., proximate an upper side of the protective pocket).

The present invention also relates to methods for providing a memento from a competitive athletic event (e.g., a race) using protective pockets disclosed herein. The method includes at least the steps of providing a race bib having athlete-identifying numbers or indicia thereon; placing the race bib in a protective pocket (as described above) before the competitive athletic event (the protective pocket including a mesh member having a perimeter and being secured to an outer surface of an apparel item worn during the competitive athletic event), such that the athlete-identifying numbers or indicia of the race bib face outwardly so as to be visible through the mesh member; exposing at least a portion of the race bib to elements encountered during the competitive athletic event (e.g., mud), wherein the memento is formed by the deposition of the elements on said race bib; and removing the memento from the protective pocket after the competitive athletic event.

When the method uses the protective pocket 10 or 110 (see FIGS. 3-6), the foregoing race bib placing step includes inserting the race bib 30 into the protective pocket 10 or 110 via the opening 26 or 126 thereof. When the method uses the protective pocket 210 (see FIGS. 7-9), the foregoing race bib placing step includes moving at least a portion of the perimeter 224 of the mesh member 222 away from the apparel item 240, so as to at least partially separate the mesh member 222 from the apparel item 240, thereby separating the first and second border member portions 225*a*, 225*b* from one another, at least partially, by disengaging the first and second closure means 225*c*, 225*d* thereof; positioning the race bib 230 adjacent the outer surface of the apparel item 240, so as to be surrounded by the first border member portion 225*a*; moving the displaced portion of the perimeter 224 towards the apparel item 240; and securing the first border member 225*a* portion to the second border member 225*b* portion via the first and second closure means 225*c*, 225*d*.

It should be noted that the present invention can have numerous modifications and variations. For example, the opening of the protective pocket may be formed on the "bottom" or on one of the left- or right-hand sides of the mesh member rather than the top (as disclosed above), it being understood that the designations first, second, third and fourth sides are arbitrary, and may each be used to describe any side of the mesh member.

Further, while a number of embodiments of the present invention have been described, it is understood that these embodiments are illustrative only, and not restrictive, and that many additional modifications and/or alternative embodiments may become apparent to those of ordinary skill in the art. Therefore, it will be understood that the appended claims are intended to cover all such modifications and embodiments that come within the spirit and scope of the present invention.

I claim:

1. A protective pocket for use with an apparel item, comprising:

at least a portion of said apparel item having an inner surface and an outer surface opposite said inner surface;

a border member secured to said outer surface of said apparel item; and a mesh member attached to said border member along at least a portion thereof, such that said mesh member and apparel item cooperate to form said protective pocket therebetween, wherein said protective pocket is configured to removeably receive a race bib and maintain the race bib in a substantially vertical planar orientation, so as to be substantially parallel to said outer and inner surfaces of said apparel item.

2. The protective pocket of claim 1, wherein said mesh member includes a plurality of spaced apertures that allow the exposure of the race bib to elements encountered during a race, and wherein said plurality of spaced apertures facilitates visibility of the race bib therethrough.

3. The protective pocket of claim 1, wherein said mesh member has a perimeter including a first side, a second side, a third side opposite said first side, and a fourth side opposite said second side and adjacent an upper end of said mesh member, said mesh member cooperating with a portion of said outer surface of said apparel item to form said protective pocket therebetween, said protective pocket having an opening adjacent said fourth side of said perimeter for permitting the insertion and removal of the race bib into and from said protective pocket.

4. The protective pocket of claim 1, wherein said border member includes a first border member portion secured to said outer surface of said apparel item and having first closure means, and a second border member portion secured to said perimeter of said mesh member and having second closure means, said second closure means being engageable with said first closure means to removeably secure said mesh member to said apparel item and form said protective pocket therebetween.

5. The protective pocket of claim 4, wherein said first closure means and said second closure means are a hook and loop fastener system.

6. The protective pocket of claim 1, wherein said apparel item is selected from the group consisting of a shirt, a tank top, shorts, pants, a jacket, a sports bra, yoga pants, yoga shorts, boy shorts, a track and field jersey, a triathlon jersey and a cycling jersey.

7. The protective pocket of claim 2, further comprising elements encountered during a race disposed on one or more portions of the race bib that are exposed by said plurality of shaped apertures of said mesh member.

8. The protective pocket of claim 7, wherein said elements encountered during a race include mud.

9. In combination:

an apparel item, at least a portion of which includes an outer surface and an inner surface opposite said outer surface;

a race bib having numerals thereon identifying a race participant;

a protective pocket removeably attached to said apparel item, said protective pocket including a mesh member having a perimeter, said mesh member cooperating with a portion of said outer surface of said apparel item to form said protective pocket therebetween, said protective pocket containing said race bib, said race bib obscuring said portion of said outer surface of said apparel item from view, said mesh member further including a plurality of spaced apertures sized, shaped and arranged so as to facilitate visibility of said race bib and said numerals therethrough and to allow exposure of said race bib to elements encountered during a race; and a border member including a first border member portion secured to said outer surface of said apparel item and having first closure means, and a second border member portion secured to said perimeter of said mesh member and having second closure means, said second closure means being engageable with said first closure means to removeably secure said mesh member to said apparel item and form said protective pocket therebetween, wherein said protective pocket is configured to removeably receive said race bib therein.

10. The combination of claim 9, wherein said protective pocket is configured to maintain said race bib in a substantially vertical planar orientation, so as to be substantially parallel to said inner and outer surfaces of said apparel item.

11. The combination of claim 9, wherein said race bib has a generally rectangular shape including a first length and a first width, and wherein said protective pocket has a generally rectangular shape complementary to said generally rectangular shape of said race bib and has a second length and second width complementary to said first length and said first width, respectively, of said race bib.

12. The combination of claim 9, wherein said first closure means and said second closure means are a hook and loop fastener system.

13. The combination of claim 9, wherein said apparel item is selected from the group consisting of a shirt, a tank top, shorts, pants, a jacket, a sports bra, yoga pants, yoga shorts, boy shorts, a track and field jersey, a triathlon jersey and a cycling jersey.

14. The combination of claim 9, further comprising elements encountered during a race disposed on one or more portions of said race bib that are exposed by said plurality of shaped apertures of said mesh member.

15. The combination of claim 14, wherein said elements encountered during a race include mud.

16. A method for providing a memento from a competitive athletic event, said method comprising the steps of:

providing a race bib having athlete-identifying numbers or indicia thereon;

placing the race bib in a protective pocket before the competitive athletic event, the protective pocket including a mesh member having a perimeter and being secured to an outer surface of an apparel item worn during the competitive athletic event, such that the athlete-identifying numbers or indicia of the race bib face outwardly so as to be visible through the mesh member;

exposing at least a portion of the race bib to elements encountered during the competitive athletic event, wherein said memento is formed by the deposition of the elements on said race bib; and removing said memento from the protective pocket after the competitive athletic event.

17. The method of claim 16, wherein the protective pocket has an opening adjacent the perimeter of the mesh member, and whereby said race bib placing step includes inserting the race bib into the protective pocket via the opening.

18. The method of claim 16, wherein the protective pocket has a border member including a first border member portion secured to the outer surface of the apparel item and having first closure means, and a second border member portion secured to a perimeter of the mesh member and having second closure means, and wherein said race bib placing step includes:

moving at least a portion of the perimeter of the mesh member away from the apparel item, so as to at least partially separate the mesh member from the apparel item, thereby separating the first and second border member portions from one another, at least partially, by disengaging the first and second closure means;

positioning the race bib adjacent the outer surface of the apparel item, so as to be surrounded by the first border member portion;

moving the at least displaced portion of the perimeter towards the apparel item; and securing the first border member portion to the second border member portion via the first and second closure means.

19. The method of claim 16, wherein said elements include mud.

* * * * *